US007099605B2

(12) United States Patent
Namiki

(10) Patent No.: US 7,099,605 B2
(45) Date of Patent: Aug. 29, 2006

(54) OPTIONAL APPARATUS FOR IMAGE FORMING APPARATUS

(75) Inventor: Teruhiko Namiki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/267,138

(22) Filed: Nov. 7, 2005

(65) Prior Publication Data

US 2006/0099003 A1 May 11, 2006

(30) Foreign Application Priority Data

Nov. 8, 2004 (JP) ..... 2004-324077

(51) Int. Cl.
*G03G 15/00* (2006.01)

(52) U.S. Cl. ..... 399/88; 399/90; 399/110; 399/113; 399/408; 399/410

(58) Field of Classification Search ..... 399/88, 399/90, 110, 113, 381, 383, 407, 408, 410, 399/36, 37

See application file for complete search history.

(56) References Cited

U.S. PATENT DOCUMENTS

| | | | | |
|---|---|---|---|---|
| 6,055,062 | A * | 4/2000 | Dina et al. | 358/1.13 |
| 6,120,020 | A * | 9/2000 | Asao | 271/189 |
| 2001/0005067 | A1* | 6/2001 | Yamada et al. | 271/302 |
| 2002/0000692 | A1* | 1/2002 | Yamada et al. | 271/279 |
| 2003/0198494 | A1* | 10/2003 | Kenji et al. | 399/381 |
| 2004/0046311 | A1* | 3/2004 | Sekiyama et al. | 271/189 |

* cited by examiner

*Primary Examiner*—David M. Gray
*Assistant Examiner*—Geoffrey T. Evans
(74) *Attorney, Agent, or Firm*—Fitzpatrick, Cella, Harper & Scinto

(57) ABSTRACT

An optional apparatus for an image forming apparatus which forms an image on a print medium, which is detachably connected to the image forming apparatus and performs predetermined optional processing for a print medium supplied from the image forming apparatus, is provided. The optional apparatus includes a storage battery which can be charged/discharged, an optional processing unit configured to execute the predetermined optional processing upon receiving supply of power at least from the image forming apparatus or from the storage battery, and a switch unit configured to cut off supply of power from the storage battery to the optional processing unit when the optional apparatus is detached from the image forming apparatus or a door of the optional apparatus is opened.

5 Claims, 10 Drawing Sheets

OPTIONAL APPARATUS FOR IMAGE FORMING APPARATUS

FIELD OF THE INVENTION

The present invention relates to an optional apparatus for an image forming apparatus, which performs predetermined optional processing for a print medium supplied from the image forming apparatus.

BACKGROUND OF THE INVENTION

Recently, the market has demanded more that new values, such as option expandability and energy saving, be added to image forming apparatuses. In addition, it has been required to supply power from an image forming apparatus to an optional apparatus so as to improve the design of the optional apparatus when it is mounted and allow a user to easily detach/attach it.

When, however, power is to be supplied from the image forming apparatus body to, for example, an optional apparatus designed to perform stapling processing, since high power is required for stapling operation, a large-capacity power supply circuit must be prepared for the image forming apparatus body in expectation of the maximum load on the optional apparatus. This leads to an unnecessary increase in cost for a user who uses only the image forming apparatus. It has therefore been required to minimize an increase in the cost of the image forming apparatus body by reducing the maximum power consumed by the optional apparatus itself.

In addition, a demand has arisen for a means for reducing the maximum powers of an image forming apparatus and optional apparatus to prevent the maximum power of the system from exceeding the maximum power that can be supplied from a one-system commercial power supply so as to prevent a protective means such as the circuit breaker of the commercial power supply from activation.

On the other hand, an image forming apparatus or an optional apparatus individually having a power supply uses an arrangement designed to cut off, for safety, power supplied to a driving means, heating means, or the like placed at a position where a user can touch when the user opens the image forming apparatus in case of paper jam.

When a storage battery is provided for an optional apparatus which receives power from an image forming apparatus, the following problem arises. Although power from the image forming apparatus to the optional apparatus is cut off when the optional apparatus is detached from the image forming apparatus or the optional apparatus is opened, electric charge remaining in the storage battery may allow a driving means of the optional apparatus to operate.

SUMMARY OF THE INVENTION

In view of the above problems in the conventional art, the present invention has an object to take measures for safety in an optional apparatus which receives power supplied from an image forming apparatus and including a storage battery when the optional apparatus is detached from the image forming apparatus or the optional apparatus is opened.

According to one aspect of the present invention, an optional apparatus for an image forming apparatus which forms an image on a print medium, which is detachably connected to the image forming apparatus and performs predetermined optional processing for a print medium supplied from the image forming apparatus, is provided. The optional apparatus includes a storage battery which can be charged/discharged, an optional processing unit configured to execute the predetermined optional processing upon receiving supply of power at least from the image forming apparatus or from the storage battery, and a switch unit configured to cut off supply of power from the storage battery to the optional processing unit when the optional apparatus is detached from the image forming apparatus or a door of the optional apparatus is opened.

The above and other objects and features of the present invention will appear more fully hereinafter from a consideration of the following description taken in connection with the accompanying drawing wherein one example is illustrated by way of example.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will be described in detail in accordance with the accompanying drawings. The present invention is not limited by the disclosure of the embodiments and all combinations of the features described in the embodiments are not always indispensable to solving means of the present invention.

(First Embodiment)

Figure 1:
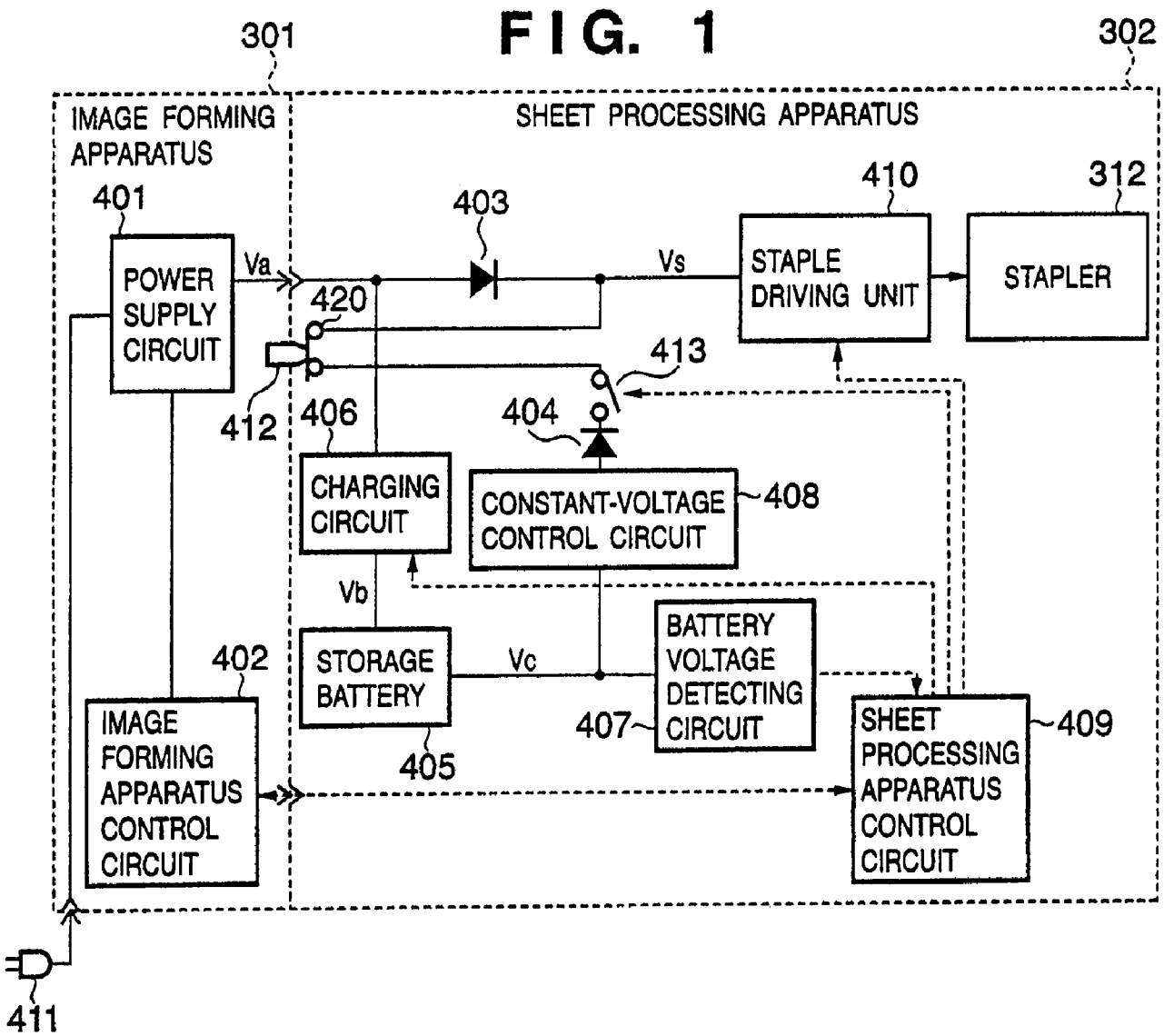
FIG. 1 is a block diagram showing the arrangements of an image forming apparatus and sheet processing apparatus according to the first embodiment.

FIG. 1 is a block diagram showing the arrangements of an image forming apparatus 301 and a sheet processing apparatus 302 as an optional apparatus according to this embodiment. The sheet processing apparatus 302 is designed to be detachable with respect to the image forming apparatus 301.

When the sheet processing apparatus 302 is mounted on the image forming apparatus 301, they are electrically connected to each other.

The image forming apparatus 301 comprises a power supply circuit 401, an image forming apparatus control circuit 402 which controls image forming processing, and a switch press member 412 which presses a switch 420 of the sheet processing apparatus 302. Power is supplied from a commercial power supply (not shown) to the power supply circuit 401 through a power cord 411. As other constituent elements of the image forming apparatus 301, known elements can be used. An illustration of these elements is omitted because they are not significantly relevant to the present invention.

The sheet processing apparatus 302 in this embodiment staples a bundle of a predetermined number of printing media (to be referred to as sheets hereinafter) upon image formation, thus executing an optional function for the image forming apparatus 301. Reference numeral 312 denotes a stapler which binds a plurality of sheets discharged from the image forming apparatus 301; 403 and 404, diodes; 405, a storage battery which can charge and discharge; 406, a charging circuit which charges the storage battery 405; 407, a battery voltage detecting circuit which detects the output voltage of the storage battery 405; 408, a constant-voltage control circuit which controls the output voltage from the storage battery 405 to a predetermined voltage; 409, a sheet processing apparatus control circuit which controls the conveyance of sheets and stapling operation; 410, a staple driving unit which drives the stapler 312; 420, the switch which is turned on by being pressed by the switch press member 412 only when the sheet processing apparatus 302 is connected to the image forming apparatus 301; and 413, a switch which is turned on/off in accordance with an instruction from the sheet processing apparatus control circuit 409.

The operation of the sheet processing apparatus 302 will be described next.

The power supply circuit 401 of the image forming apparatus 301 applies a predetermined voltage to the image forming apparatus control circuit 402 and applies a predetermined voltage Va to the sheet processing apparatus 302 set as an option through a connector. The image forming apparatus control circuit 402 also communicates with the sheet processing apparatus control circuit 409 in the sheet processing apparatus 302 through a connector to perform timing control to smoothly convey sheets and perform stapling operation.

The charging circuit 406 receives the voltage Va applied from the power supply circuit 401, and applies a predetermined voltage Vb (Va<Vb in this case) to the storage battery 405 including, for example, a plurality of electric double layer capacitor in accordance with a charge instruction from the sheet processing apparatus control circuit 409, thereby charging the storage battery 405 to a predetermined voltage Vc Vc (≈Vb). Note that an electric double layer capacitor is an element attracting a great deal of attention in many fields because it has as large as a capacitor of several F or more, charging efficiency better than a secondary battery, and long service life.

The battery voltage detecting circuit 407 detects the charged voltage of the storage battery 405, and transmits the detection result as, for example, an analog signal to the A/D port of a CPU (not shown) in the sheet processing apparatus control circuit 409. The sheet processing apparatus control circuit 409 issues a charge instruction to the charging circuit 406 in accordance with the detection result from the battery voltage detecting circuit 407.

The constant-voltage control circuit 408 controls a charged voltage Vc for the storage battery 405 to a voltage Vs (Vs≈Va−Vf, Vs<Vc, forward voltage Vf of diode 403=about 0.6 V) necessary for stapling operation, and applies the voltage Vs to the staple driving unit 410 through the switches 413 and 420, thereby driving the stapler 312.

As described above, the switch 420 is designed to be turned on by being pressed by the switch press member 412 only when the sheet processing apparatus 302 is connected to the image forming apparatus 301. As the switch 413, a semiconductor switch such as an FET is preferably used in consideration of on/off durability. If, however, no problem arises in terms of service life associated with an on/off count, a mechanical switch such as a relay may be used.

The diode 403 serves to prevent an output from the power supply circuit 401 from being applied to the staple driving unit 410 when the voltage Vs is applied from the storage battery 405 through the constant-voltage control circuit 408 and to prevent power from the storage battery 405 from being supplied to the image forming apparatus 301.

Figure 2:
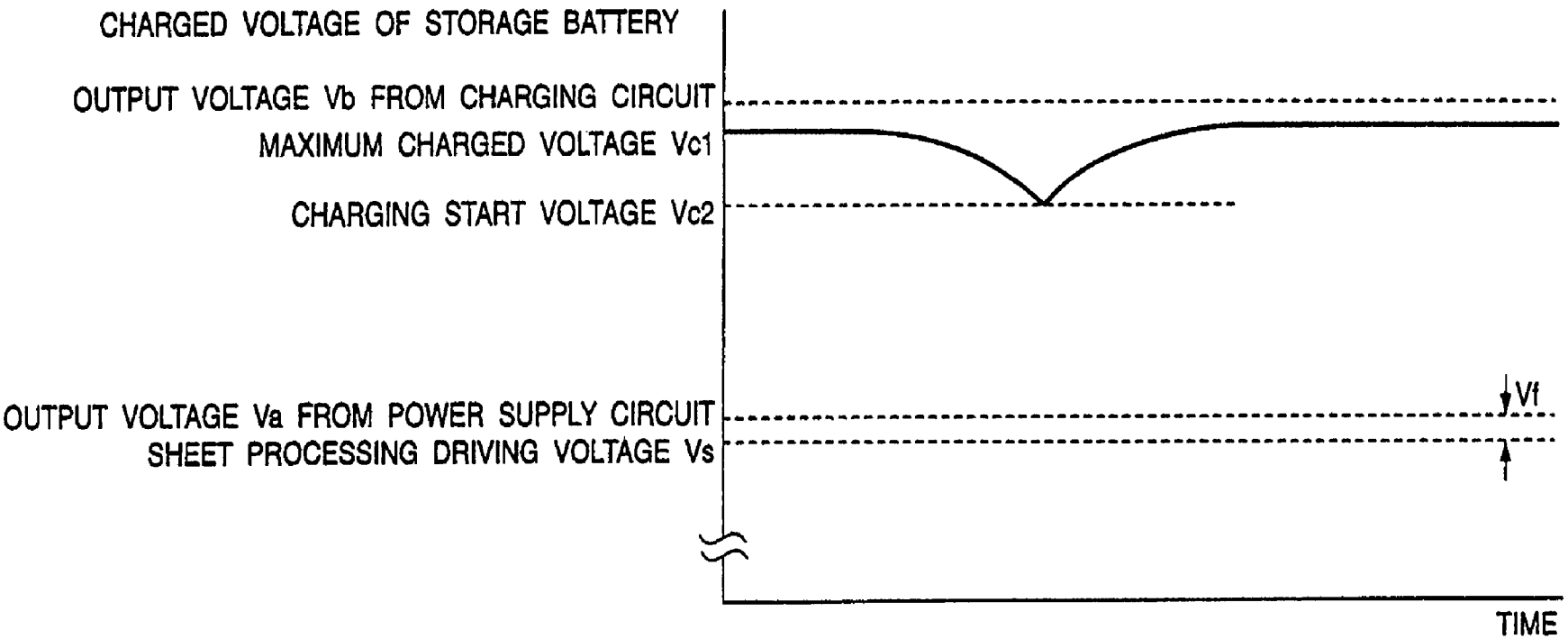
FIG. 2 is a graph for explaining an output voltage from a storage battery in this embodiment.
Figure 3:
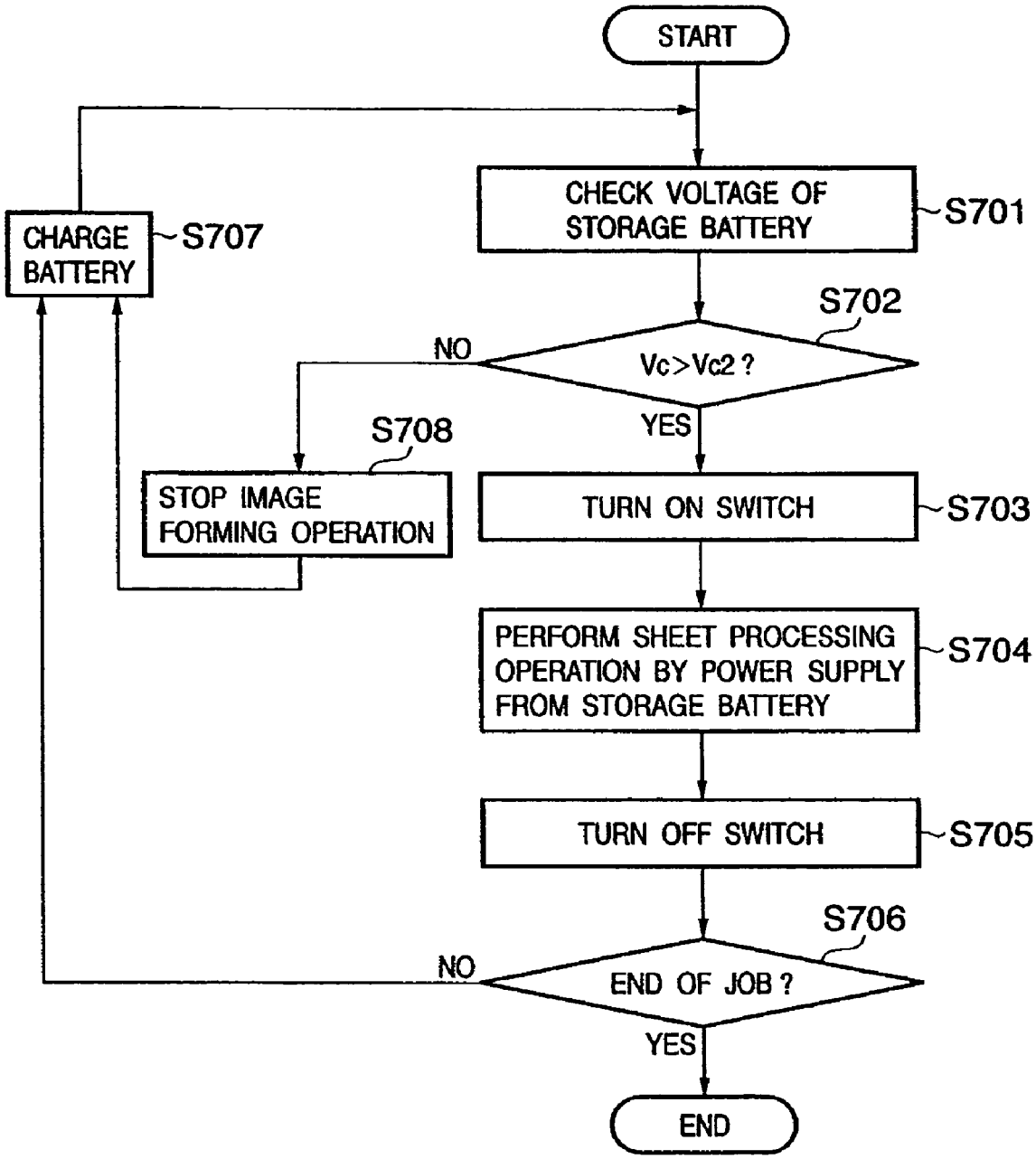
FIG. 3 is a flowchart showing sheet processing operation by power supply from the storage battery in this embodiment.

Stapling operation by power supply from the storage battery 405 will be described next with reference to FIGS. 2 and 3. FIG. 2 is a view for explaining an output voltage from the storage battery 405. FIG. 3 is a flowchart showing sheet processing operation (stapling operation) by power supply from the storage battery 405.

When a predetermined number N of sheets are placed on a stack tray (not shown), the sheet processing apparatus control circuit 409 monitors the charged voltage Vc from the storage battery 405 (step S701), and checks whether the voltage Vc falls within a voltage range of Vc1>Vc>Vc2 between a maximum charged voltage Vc1 and a charging start voltage Vc2 (step S702). If the voltage Vc falls within the predetermined range, the sheet processing apparatus control circuit 409 applies the voltage Vs to the staple driving unit 410 through the switch 420 by turning on the switch 413 in accordance with the timing of image forming operation (step S703). The staple driving unit 410 drives the stapler 312 by using the supply voltage Vs and staples the sheet bundle (step S704). Since stapling operation is performed by the energy stored in the storage battery 405, the maximum consumption current in the sheet processing apparatus 302 which flows from the power supply circuit 401 to the sheet processing apparatus 302 for a short period of time at the time of stapling operation is reduced. That is, since the maximum current (maximum consumption power) flowing in the sheet processing apparatus 302 is reduced, the maximum consumption current of the system formed when the sheet processing apparatus 302 is connected to the image forming apparatus 301 can be reduced.

After the stapling operation, the switch 413 is turned off (step S705). It is then determined whether the job is complete (step S706). If the job is complete, the process is terminated. If the job is not complete, the storage battery 405 is charged to prepare for the next stapling job (step S707). If the charged voltage Vc falls within the predetermined voltage range of Vc1>Vc>Vc2 at this time, the storage battery 405 need not necessarily be charged in advance, and the switch 413 need not be turned off either. It suffices to turn off the switch 413 and start charging when the charged voltage Vc becomes lower than charging start voltage Vc2.

If it is determined in step S702 that the charged voltage Vc is lower than the charging start voltage Vc2, the necessary voltage Vs may not be applied to the staple driving unit 410 depending on conditions such as a printing speed and the number of sheets to be stapled. That is, since stapling may not be done, image forming operation is temporarily stopped (step S708). The flow then advances to step S707 to ensure a charging time by which the storage battery 405 is charged to the maximum voltage Vc1.

Figure 4:
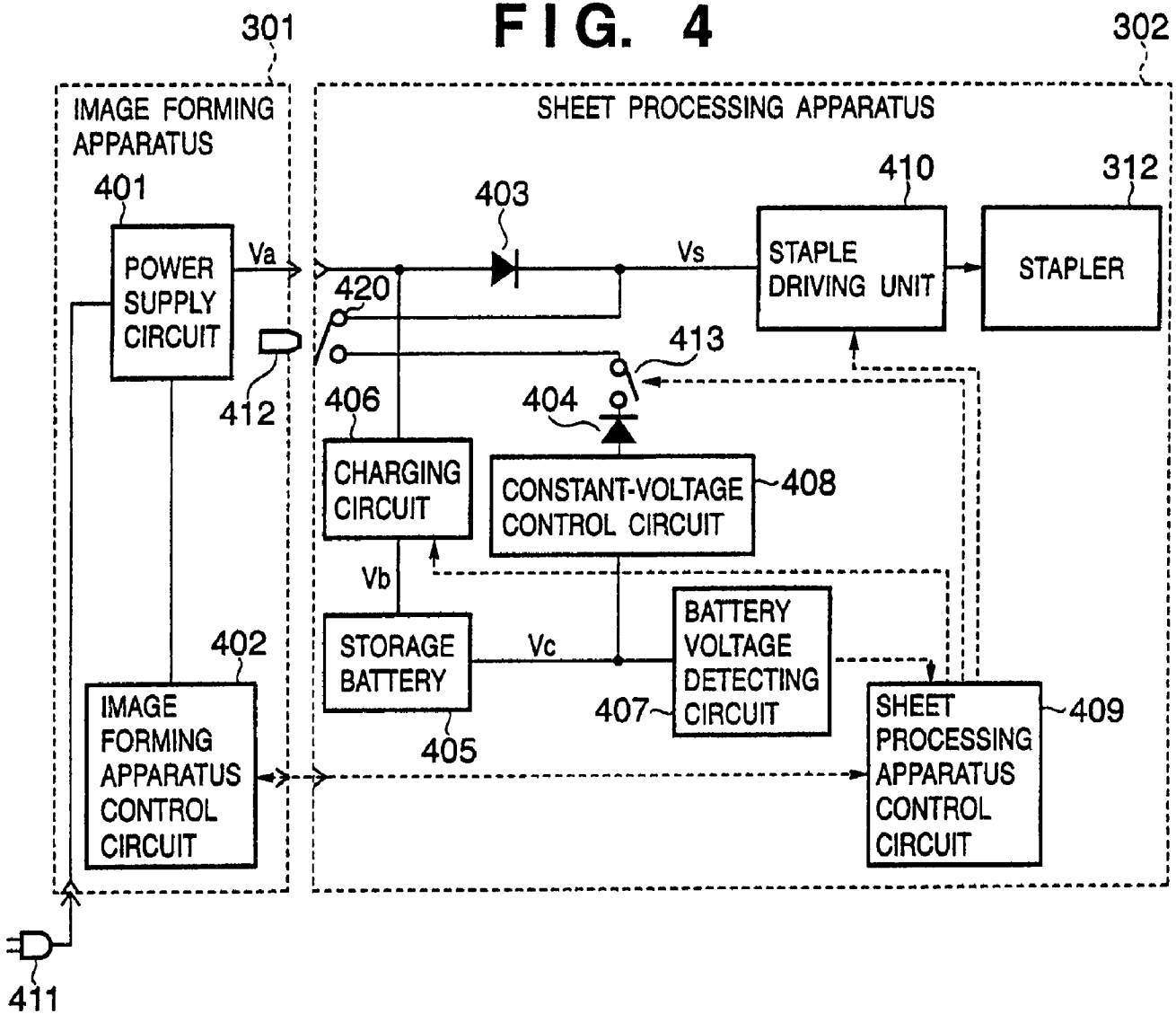
FIG. 4 is a block diagram showing a case wherein the sheet processing apparatus is detached from the image forming apparatus in the first embodiment.

FIG. 4 shows a case wherein the sheet processing apparatus 302 is detached from the image forming apparatus 301. When the sheet processing apparatus 302 is detached from the image forming apparatus 301, power supplied from the power supply circuit 401 to the staple driving unit 410 is cut off. In addition, when the switch press member 412 is detached from the switch 420, the switch 420 is opened to cut off the power supplied from the storage battery 405 to the staple driving unit 410.

As described above, in the image forming apparatus designed to supply power from the power supply circuit 401 in the image forming apparatus 301 to the storage battery 405 in the sheet processing apparatus 302 as the optional apparatus, the amount of power supplied from the power supply circuit 401 at the time of stapling operation can be reduced. In addition, when the sheet processing apparatus 302 is detached from the image forming apparatus 301, the supply of power from the power supply circuit 401 is cut off. In addition, since the switch 420 between the storage battery 405 and the staple driving unit 410 is turned off, the supply of power from the storage battery 405 to the staple driving unit 410 can be reliably cut off. This makes it possible to ensure high safety.

(Second Embodiment)

Figure 5:
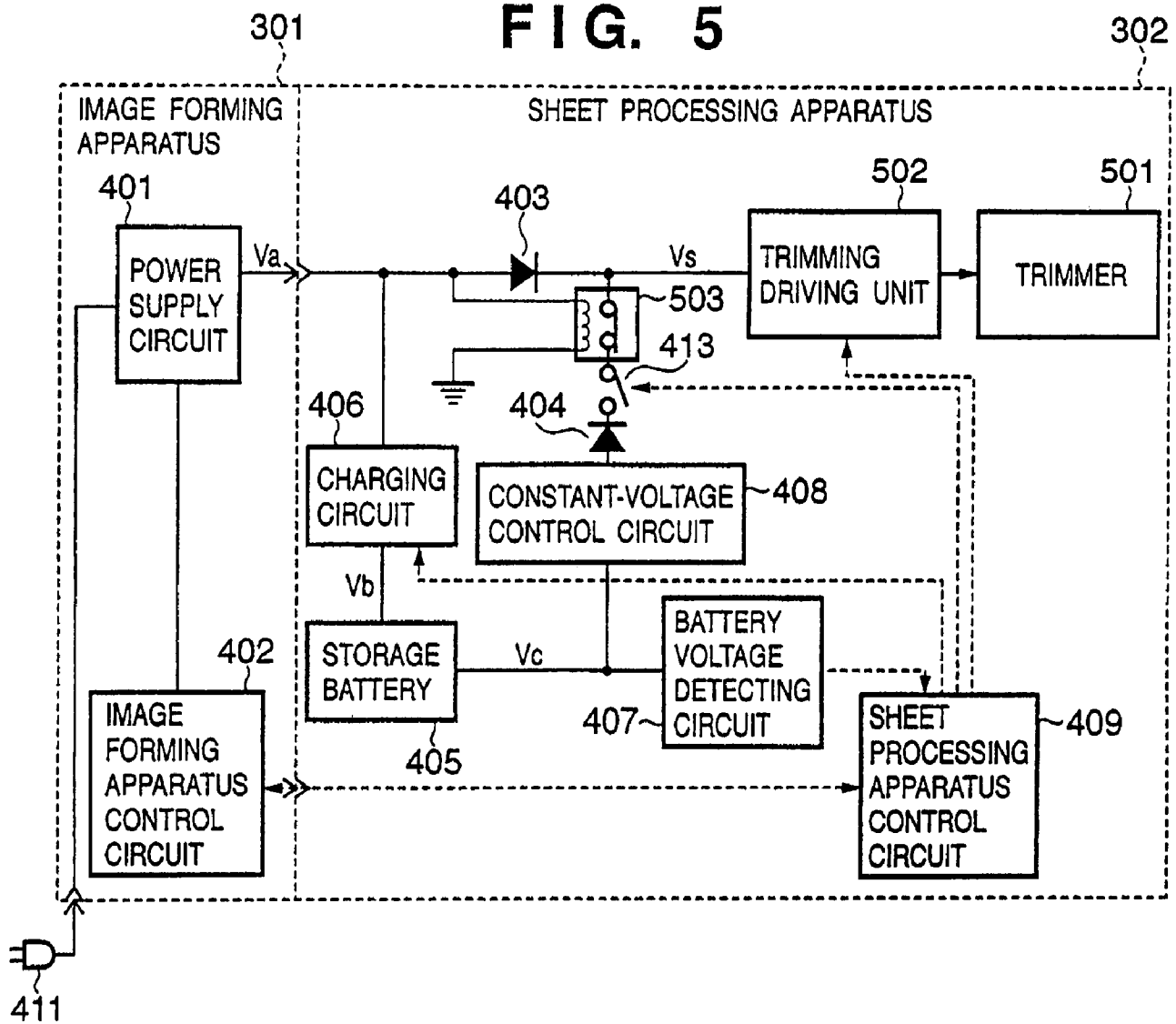
FIG. 5 is a block diagram showing the arrangements of an image forming apparatus and sheet processing apparatus according to the second embodiment.

FIG. 5 is a block diagram showing the arrangements of an image forming apparatus and sheet processing apparatus according to the second embodiment.

A sheet processing apparatus 302 in this embodiment performs trimming processing of cutting a bundle of a predetermined number of sheets after image formation as an optional function for an image forming apparatus 301. The same reference numerals as in FIG. 1 denote the same parts in FIG. 5, and a description thereof will be omitted. In addition, a description of the output voltage of a storage battery and operation based on the supply of power from a storage battery are the same as those described with reference to FIGS. 2 and 3, and a description thereof will be omitted (this also applies to the following embodiments).

The arrangement and operation of the sheet processing apparatus 302 in this embodiment shown in FIG. 5 will be described below.

Reference numeral 501 denotes a trimmer which cuts sheets; 502, a trimming driving unit which drives the trimmer 501, and 503, a relay.

A power supply circuit 401 of the image forming apparatus 301 applies a predetermined voltage to an image forming apparatus control circuit 402, and also applies a predetermined voltage Va to the sheet processing apparatus 302 set as an option through a connector. The image forming apparatus control circuit 402 communicates with a sheet processing apparatus control circuit 409 in the sheet processing apparatus 302 through a connector, and performs timing control to smoothly convey sheets and smoothly perform trimming operation.

A charging circuit 406 receives the voltage Va from the power supply circuit 401, and applies a predetermined voltage Vb (Va<Vb in this case) to a storage battery 405 in accordance with a charge instruction from the sheet processing apparatus control circuit 409, thereby charging the storage battery 405 to a predetermined voltage Vc (≈Vb).

A battery voltage detecting circuit 407 detects the charged voltage of the storage battery 405, and transmits the detection result as, for example, an analog signal to the A/D port of a CPU (not shown) in the sheet processing apparatus control circuit 409. The sheet processing apparatus control circuit 409 issues a charge instruction to the charging circuit 406 in accordance with the detection result from a battery voltage detecting circuit 407.

A constant-voltage control circuit 408 controls the charged voltage Vc of the storage battery 405 to a voltage Vs (Vs≈Va−Vf, Vs<Vc, forward voltage Vf of diode 403=about 0.6 V) necessary for trimming operation, and applies the voltage Vs to the trimming driving unit 502 through a switch 413 and the relay 503, thereby driving the trimmer 501.

The relay 503 is designed to be turned on by the supply voltage Va from the power supply circuit 401 only when the sheet processing apparatus 302 is connected to the image forming apparatus 301.

The diode 403 serves to prevent an output from the power supply circuit 401 from being applied to the trimming driving unit 502 when the voltage Vs is applied from the storage battery 405 through the constant-voltage control circuit 408 and to prevent power from the storage battery 405 from being supplied to the image forming apparatus 301.

Figure 6:
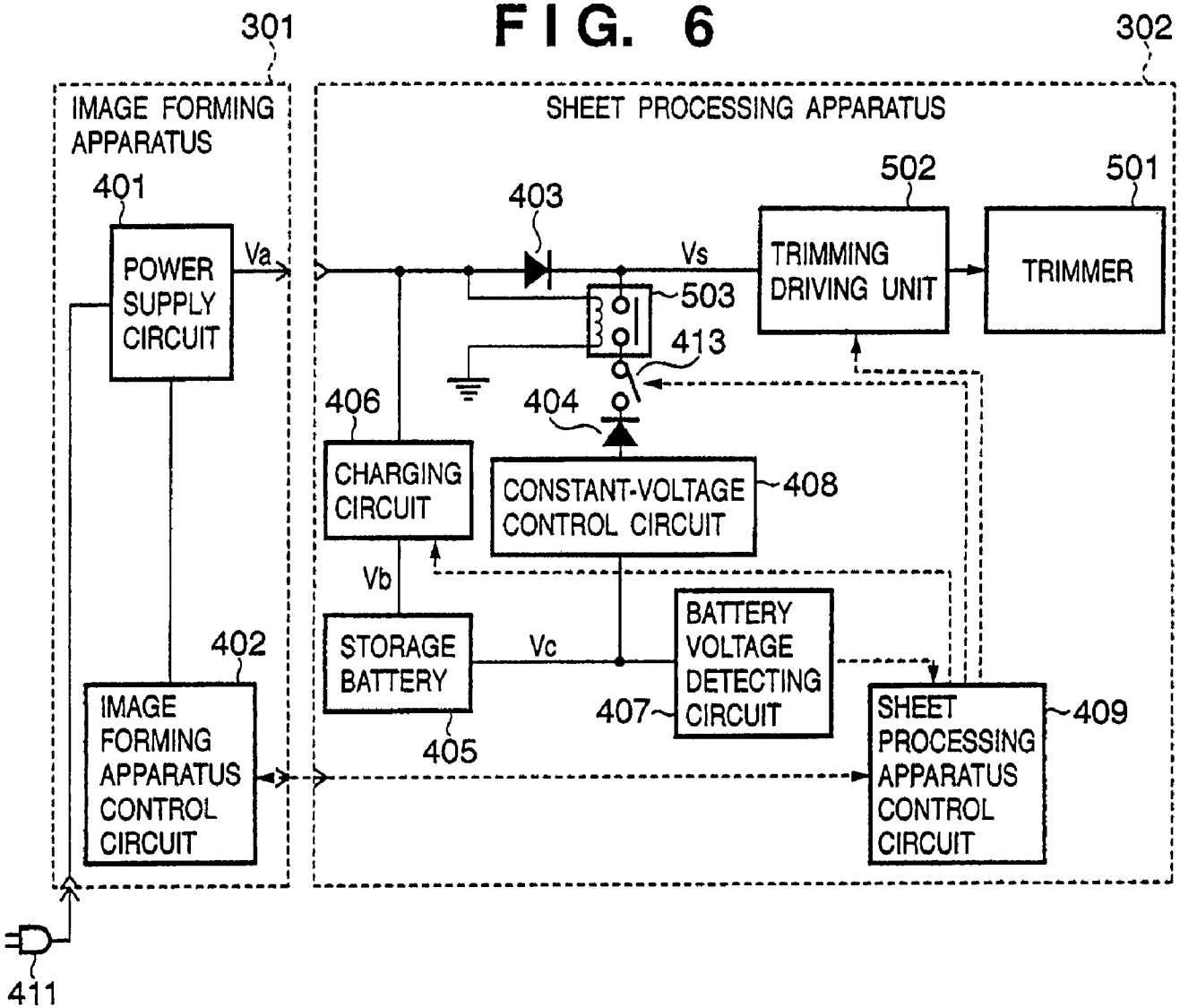
FIG. 6 is a block diagram showing a case wherein the sheet processing apparatus is detached from the image forming apparatus in the second embodiment.

FIG. 6 shows a case wherein the sheet processing apparatus 302 is detached from the image forming apparatus 301. When the sheet processing apparatus 302 is detached from the image forming apparatus 301, the supply of power from the power supply circuit 401 to the trimming driving unit 502 is cut off. In addition, the supply of power to the relay 503 is cut off and the relay 503 is opened, thereby cutting off the supply of power from the storage battery 405 to the trimming driving unit 502.

With the above arrangement, effects similar to those of the first embodiment can be obtained. That is, in the image forming apparatus designed to supply power from the power supply circuit 401 in the image forming apparatus 301 to the storage battery 405 in the sheet processing apparatus 302, the amount of power supplied from the power supply circuit 401 at the time of trimming operation can be reduced. In addition, when the sheet processing apparatus 302 is detached from the image forming apparatus 301, the supply of power from the power supply circuit 401 is cut off. In addition, since the relay 503 provided between the storage battery 405 and the trimming driving unit 502 is opened, the supply of power from the storage battery 405 to the trimming driving unit 502 can be reliably cut off. This makes it possible to ensure high safety.

As compared with the first embodiment, the path from the storage battery 405 to the trimming driving unit 502 can be shortened, and the sheet processing apparatus 302 can be reduced in size.

(Third Embodiment)

Figure 7:
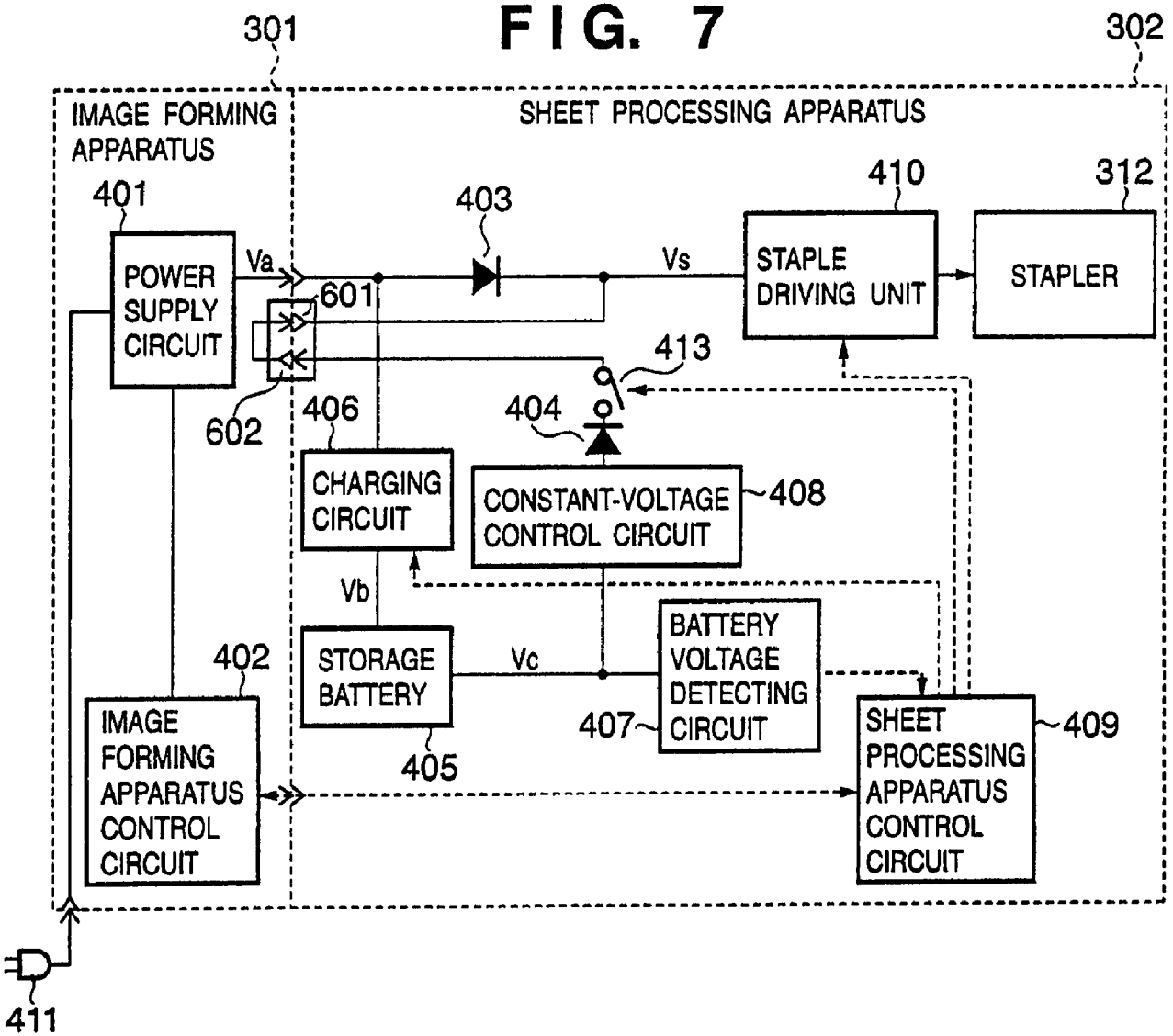
FIG. 7 is a block diagram showing the arrangements of an image forming apparatus and sheet processing apparatus according to the third embodiment.

FIG. 7 is a block diagram showing the arrangements of an image forming apparatus and sheet processing apparatus according to the third embodiment. Assume that a sheet processing apparatus 302 in this embodiment performs stapling processing in the same manner as in the first embodiment.

The arrangement and operation of the sheet processing apparatus 302 in this embodiment will be described below.

Reference numerals 601 and 602 denote drawer connectors for supplying power from a storage battery 405 to a staple driving unit 410 through an image forming apparatus 301.

A power supply circuit 401 of the image forming apparatus 301 applies a predetermined voltage to an image forming apparatus control circuit 402, and also applies a predetermined voltage Va to the sheet processing apparatus 302 set as an option through a connector. The image forming apparatus control circuit 402 also communicates with a sheet processing apparatus control circuit 409 in the sheet processing apparatus 302 through a connector and performs timing control to smoothly convey sheets and smoothly perform stapling operation.

A charging circuit 406 receives the voltage Va from the power supply circuit 401, and applies a predetermined voltage Vb (Va<Vb in this case) to the storage battery 405 in accordance with a charge instruction from the sheet processing apparatus control circuit 409, thereby charging the storage battery 405 to a predetermined voltage Vc (=. Vb).

A battery voltage detecting circuit 407 detects the charged voltage of the storage battery 405, and transmits the detection result as, for example, an analog signal to the A/D port of a CPU (not shown) in the sheet processing apparatus control circuit 409. The sheet processing apparatus control circuit 409 issues a charge instruction to the charging circuit 406 in accordance with the detection result from the battery voltage detecting circuit 407.

A constant-voltage control circuit 408 controls the charged voltage Vc of the storage battery 405 to a voltage Vs (Vs≈Va−Vf, Vs<Vc, forward voltage Vf of diode 403=about 0.6 V) necessary for stapling operation, and applies the voltage Vs to the staple driving unit 410 through a switch 413 and the drawer connectors 601 and 602, thereby driving a stapler 312.

The drawer connectors 601 and 602 are designed to be rendered conductive only when the sheet processing apparatus 302 is connected to the image forming apparatus 301. The diode 403 serves to prevent an output from the power supply circuit 401 from being applied to the staple driving unit 410 when the voltage Vs is applied from the storage battery 405 through the constant-voltage control circuit 408 and to prevent power from the storage battery 405 from being supplied to the image forming apparatus 301.

Figure 8:
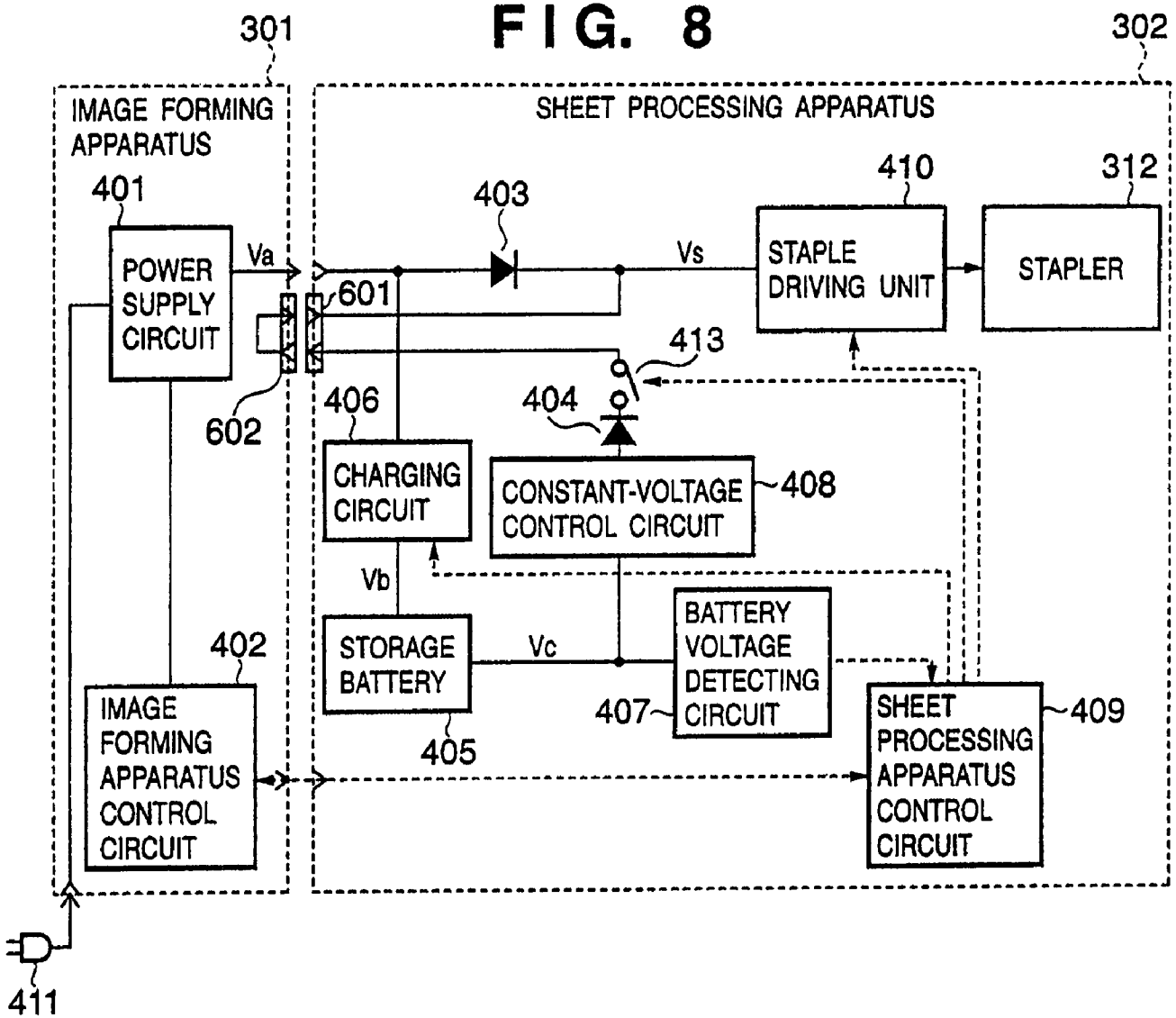
FIG. 8 is a block diagram showing a case wherein the sheet processing apparatus is detached from the image forming apparatus in the third embodiment.

FIG. 8 shows a case wherein the sheet processing apparatus 302 is detached from the image forming apparatus 301. When the sheet processing apparatus 302 is detached from the image forming apparatus 301, the supply of power from the power supply circuit 401 to the staple driving unit 410 is cut off. In addition, when the drawer connectors 601 and 602 are detached, the supply of power from the storage battery 405 to the staple driving unit 410 is also cut off.

With the above arrangement, effects similar to those of the first embodiment can be obtained.

(Fourth Embodiment)

Figure 9:
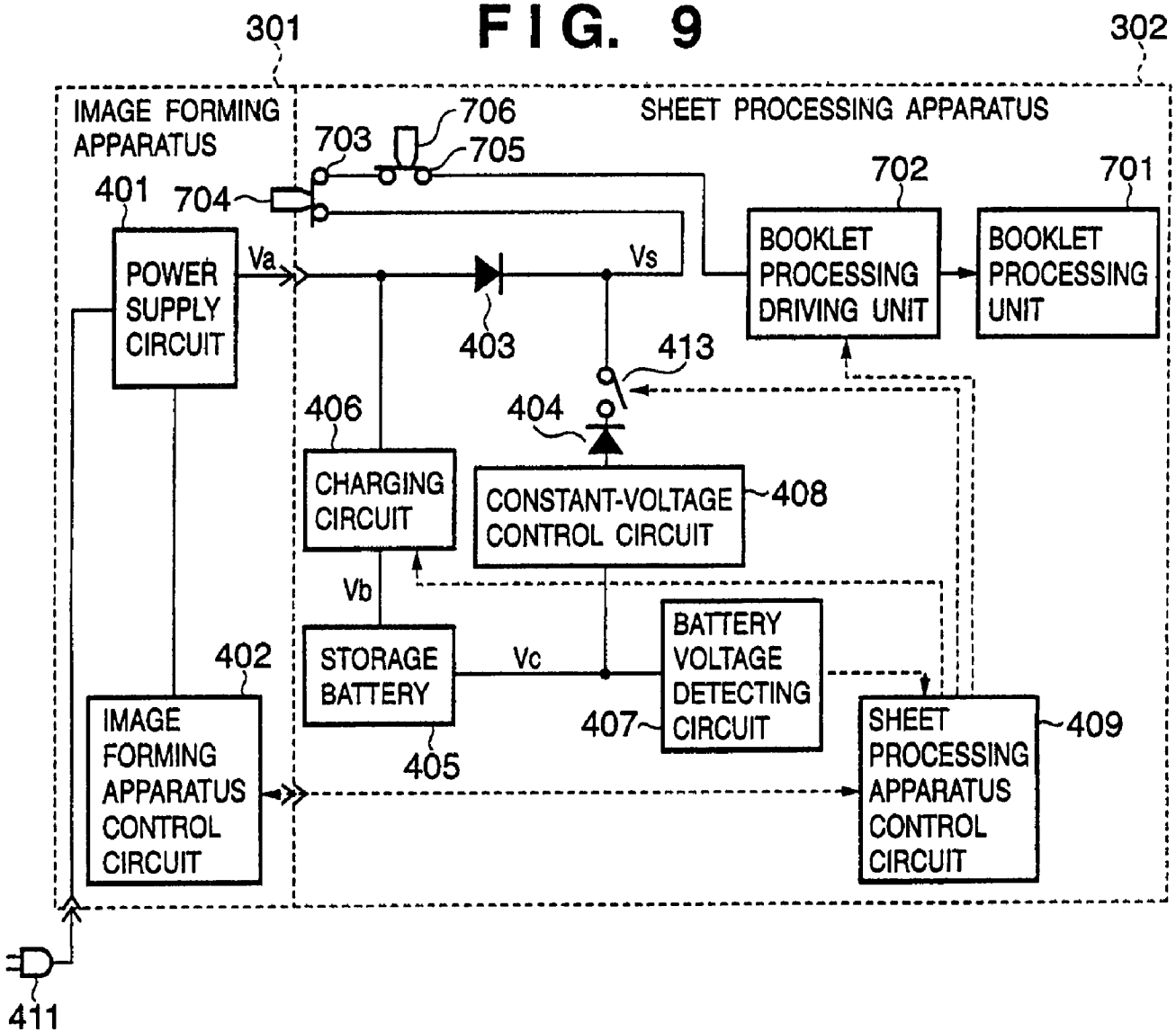
FIG. 9 is a block diagram showing the arrangements of an image forming apparatus and sheet processing apparatus according to the fourth embodiment.

FIG. 9 is a block diagram showing the arrangements of an image forming apparatus and sheet processing apparatus according to the fourth embodiment. Assume that a sheet processing apparatus 302 in this embodiment performs so-called booklet processing, i.e., binding a bundle of a plurality of sheets after image formation.

The arrangement and operation of the sheet processing apparatus 302 in this embodiment will be described below.

Reference numeral 701 denotes a booklet processing unit which bends supplied sheets and pastes cover sheets by using a heating unit (not shown); 702, a booklet processing driving unit which drives the booklet processing unit 701; 703, a switch which is turned on by a switch press member 704 only when the sheet processing apparatus 302 is connected to an image forming apparatus 301; and 705, a switch which is turned on by a switch press member 706 only when the door of the sheet processing apparatus 302 is closed.

A power supply circuit 401 of the image forming apparatus 301 applies a predetermined voltage to an image forming apparatus control circuit 402 and applies a predetermined voltage Va to the sheet processing apparatus 302 set as an option through a connector. The image forming apparatus control circuit 402 also communicates with a sheet processing apparatus control circuit 409 in the sheet processing apparatus 302 through a connector to perform timing control to smoothly convey sheets and perform booklet processing operation.

A charging circuit 406 receives a voltage Va applied from the power supply circuit 401, and applies a predetermined voltage Vb (Va<Vb in this case) to a storage battery 405 in accordance with a charge instruction from the sheet processing apparatus control circuit 409, and charges the storage battery 405 to a predetermined voltage Vc (≈Vb).

A battery voltage detecting circuit 407 detects the charged voltage of the storage battery 405, and transmits the detection result as, for example, an analog signal to the A/D port of a CPU (not shown) in the sheet processing apparatus control circuit 409. The sheet processing apparatus control circuit 409 issues a charge instruction to the charging circuit 406 in accordance with the detection result from the battery voltage detecting circuit 407.

A constant-voltage control circuit 408 controls the charged voltage Vc for the storage battery 405 to a voltage Vs (Vs≈Va−Vf, Vs<Vc, forward voltage Vf of diode 403=about 0.6 V) necessary for booklet processing operation, and applies the voltage Vs to the booklet processing driving unit 702 through a switch 413 and the switches 703 and 705, thereby driving the booklet processing unit 701.

The diode 403 serves to prevent an output from the power supply circuit 401 from being applied to the booklet processing driving unit 702 when the voltage Vs is applied from the storage battery 405 through the constant-voltage control circuit 408 and to prevent power from the storage battery 405 from being supplied to the image forming apparatus 301.

Figure 10:
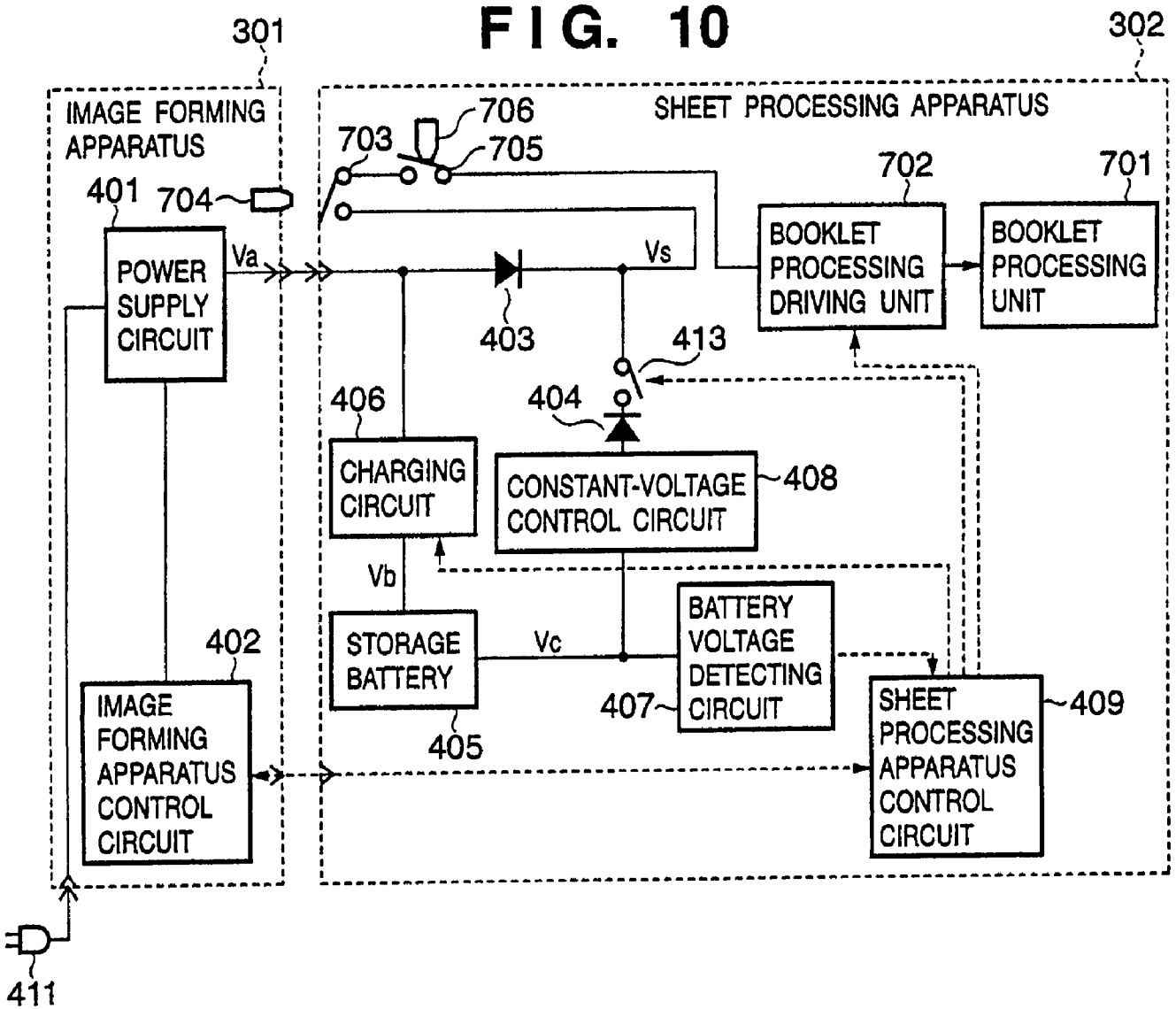
FIG. 10 is a block diagram showing a case wherein the sheet processing apparatus is detached from the image forming apparatus in the fourth embodiment.

FIG. 10 shows a case wherein the sheet processing apparatus 302 is detached from the image forming apparatus 301. When the sheet processing apparatus 302 is detached from the image forming apparatus 301, the switch 703 is opened, and power supplied from the power supply circuit 401 and storage battery 405 to the booklet processing driving unit 702 is cut off. Likewise, when the door of the sheet processing apparatus 302 is open, the switch 705 is opened to cut off the power supplied from the power supply circuit 401 and storage battery 405 to the booklet processing driving unit 702.

With the above arrangement as well, effects similar to those of the first embodiment can be obtained.

Note that this embodiment has exemplified the arrangement comprising the switch which is turned on by the switch press member 704 only when the sheet processing apparatus 302 is connected to the image forming apparatus 301 and the switches 703 and 705 which are turned on by the switch press member 706 only when the door of the sheet processing apparatus 302 is closed. However, one switch may be used instead of these switches, and may be designed to be turned on only when the sheet processing apparatus 302 is connected to the image forming apparatus 301 and the door of the sheet processing apparatus 302 is closed.

The above first to fourth embodiments each have exemplified the arrangement using a plurality of electric double layer capacitors for a storage battery. However, the present invention is not limited to the electric double layer capacitor and, for example, a secondary battery or capacitor may be used.

In addition, the above first to fourth embodiments each have exemplified the optional function of the sheet processing apparatus 302, and the sheet processing apparatuses in the respective embodiments may be obviously exchanged between them.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-324077 filed on Nov. 8, 2004, the entire contents of which are hereby incorporated by reference herein.

What is claimed is:

1. An optional apparatus for an image forming apparatus which forms an image on a print medium, which is detachably connected to the image forming apparatus and performs predetermined optional processing for a print medium supplied from the image forming apparatus, the optional apparatus comprising:

a storage battery which can be charged/discharged;

an optional processing unit configured to execute the predetermined optional processing upon receiving supply of power at least from the image forming apparatus or from said storage battery; and a switch unit configured to cut off supply of power from said storage battery to said optional processing unit when said optional apparatus is detached from the image forming apparatus or a door of said optional apparatus is opened.

2. The optional apparatus according to claim 1, wherein the predetermined optional processing is stapling processing of stapling a bundle of a plurality of supplied print media.

3. The optional apparatus according to claim 1, wherein the predetermined optional processing is trimming processing of cutting a bundle of a plurality of supplied print media.

4. The optional apparatus according to claim 1, wherein the predetermined optional processing is booklet processing of binding a bundle of a plurality of supplied print media.

5. The optional apparatus according to claim 1, wherein said storage battery includes an electric double layer capacitor.

* * * * *